United States Patent [19]

Plyler et al.

[11] 4,311,355

[45] Jan. 19, 1982

[54] WEATHERPROOF ELECTRICAL CONNECTOR

[75] Inventors: Robert G. Plyler, Vienna; John A. Yurtin, Southington, both of Ohio

[73] Assignee: General Motors Corporation, Detroit, Mich.

[21] Appl. No.: 138,809

[22] Filed: Apr. 9, 1980

Related U.S. Application Data

[63] Continuation of Ser. No. 953,410, Oct. 23, 1978, abandoned.

[51] Int. Cl.[3] ..... H01R 13/52

[52] U.S. Cl. ..... 339/94 R

[58] Field of Search ..... 339/60, 94

[56] References Cited

U.S. PATENT DOCUMENTS

| | | | |
|---|---|---|---|
| 2,704,355 | 3/1955 | Holton | 339/94 A |
| 3,321,733 | 5/1967 | Thomas | 339/90 R |
| 3,406,370 | 10/1968 | Gaw | 339/60 M |
| 3,533,047 | 10/1970 | McFarlane | 339/94 C |
| 3,643,206 | 2/1972 | Cowmeadow | 339/94 R |
| 3,760,332 | 9/1973 | Berkovits et al. | 339/66 R |
| 3,787,796 | 1/1974 | Barr | 339/60 R |
| 3,937,545 | 2/1976 | Cairns et al. | 339/60 R |
| 4,029,382 | 6/1977 | Koda | 339/94 M |

*Primary Examiner*—John McQuade
*Assistant Examiner*—Frank H. McKenzie, Jr.
*Attorney, Agent, or Firm*—F. J. Fodale

[57] ABSTRACT

A weatherproof electrical connector has an interface sealing arrangement comprising a plug connector body having towers which slide into terminal cavity enlargements in a mating socket connector body. An apertured seal pad is mounted on the towers and sealingly engages a projecting shroud of the socket connector body.

10 Claims, 6 Drawing Figures

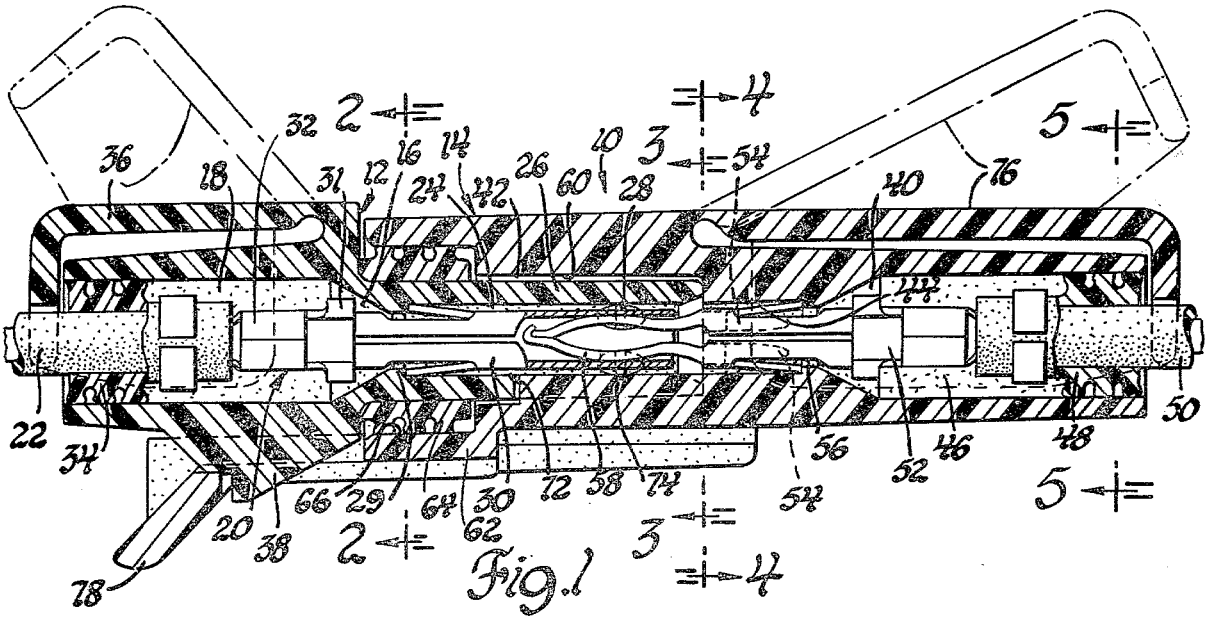
Fig.1
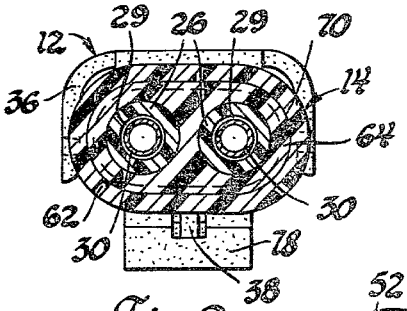
Fig.2
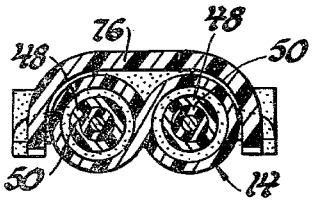
Fig.5
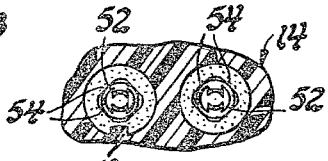
Fig.4
Fig.3
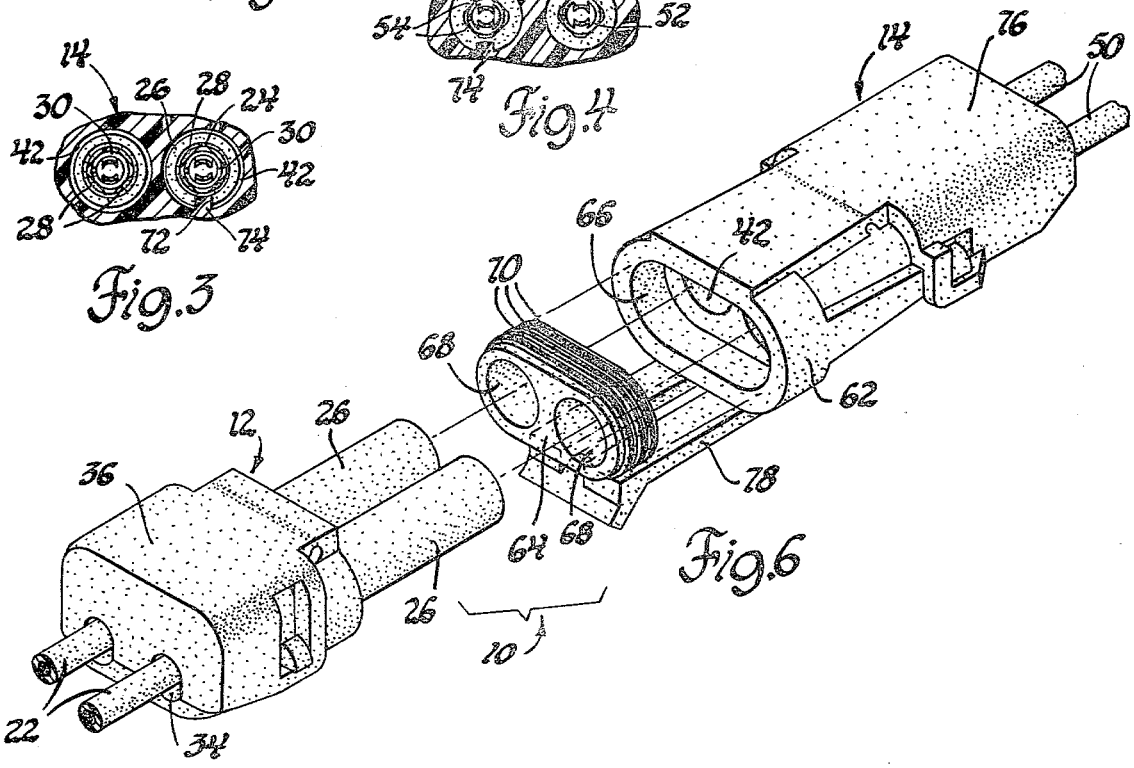
Fig.6

WEATHERPROOF ELECTRICAL CONNECTOR

This is a Continuation of application Ser. No. 953,410 filed Oct. 23, 1978, now abandoned.

This invention relates generally to sealed electrical connectors and more particularly to an interface sealing arrangement for mating electrical connector bodies.

Electrical systems of automotive vehicles, particular passenger cars, are becoming increasingly complex and sophisticated. This in turn results in increased usage of low current subsystems which, in some instances, require low current electrical connectors in a location exposed to weather conditions, such as at the vehicle underbody. For proper functioning, a low current electrical connector must be kept free of contaminants, particularly water and moisture. Yet at such a location, the connector is subjected to road splash, snow accumulation and other harmful weather effects.

The object of this invention is to provide an interface sealing arrangement for matable electrical connector bodies which protects internal electrical connections from weather conditions expected during operation of an automotive vehicle.

Another object of this invention is to provide a satisfactory interface sealing arrangement for matable electrical connector bodies which have internal low current electrical connections and which are exposed to weather conditions which subject the connector bodies to moisture and water.

Yet another object of this invention is to provide a satisfactory interface sealing arrangement for matable connector bodies which house low current electrical connections and which are located at the underbody of an automotive vehicle.

Still another object of this invention is to provide an interface sealing arrangement for mating electrical connector bodies which is substantially waterproof and moisture proof when subjected to weather conditions expected during operation of an automotive vehicle.

A feature of the invention is that the interface sealing arrangement incorporates a long barrier path guarding against entry of water and moisture without substantially increasing the overall length of the connector bodies.

Another feature of the invention is that the interface sealing arrangement also serves as a guide for mating the terminals carried in the respective electrical connector bodies.

Yet another feature of the invention is that effectiveness of the interface sealing arrangement is enhanced by placing the terminals in their respective connector bodies to maximize the longitudinal overlap of the mated connector bodies.

Still another feature of the invention is an interface sealing arrangement which provides several barriers against entry of water, moisture and other contaminants.

Other objects and features of the invention will become apparent to those skilled in the art as the disclosure is made in the following detailed description of a preferred embodiment of the invention as illustrated in the accompanying sheet of drawing in which:

FIG. 1 is a longitudinal section of a sealed electrical connector having an interface sealing arrangement in accordance with this invention;

FIG. 2 is a section taken substantially along the line 2—2 of FIG. 1 looking in the direction of the arrows;

FIG. 3 is a section taken substantially along the line 3—3 of FIG. 1 looking in the direction of the arrows;

FIG. 4 is a section taken substantially along the line 4—4 of FIG. 1 looking in the direction of the arrows;

FIG. 5 is a section taken substantially along the line 5—5 of FIG. 1 looking in the direction of the arrows; and FIG. 6 is an exploded perspective view of the electrical connector shown in FIG. 1.

Referring now to the drawing and particularly FIG. 1, there is disclosed a sealed electrical connector 10 comprising a plug connector body 12 and a socket connector body 14 each made of a molded dielectric plastic material such as nylon.

The plug connector body 12 has a pair of longitudinal cavities 16 extending through the plug connector body. Each cavity 16 has an elongated rearward portion 18 of circular outline which is open at the rear of the plug connector body 12 for assembly of a female terminal 20 attached to an insulated lead wire 22.

The forward portion 24 of each of the cavities 16 is defined by one of a pair of laterally spaced longitudinal towers 26 at the forward end of the plug connector body 12. Each forward cavity portion 24 has a chamfered opening at the forward end of its associated tower 26 and pilot means comprising four forward diagonal pads 28 and a rearward annular rib 29 which also serves as a latch shoulder.

The female terminal 20 comprises a forward elongated socket 30 in the form of a split tube which is located in the forward cavity portion 24. The elongated socket 30 is piloted on the diagonal pads 28 and the annular rib 29 and it includes a pair of diametrically opposed latch tangs which cooperate with the rib 29 to retain the female terminal 20 in the cavity 16. The rearward portion of the female terminal 20 has stop wings 31 and an attachment portion 32. The attachment portion 32 attaches a multiple lip cable seal 34, the lead wire 22 and the female terminal 20 together in an arrangement which is the subject matter of pending U.S. patent application Ser. No. 912,835 entitled "Assembly for Sealed Electrical Connector". This application was filed by Harold G. Hawkins June 5, 1978 as a Continuation of U.S. patent application Ser. No. 803,622, now abandoned.

The plug connector body 12 has a hinged flap 36 which is movable to a closed latched position after a female terminal 20 is inserted into each of the cavities 16. In its closed position, the flap 36 cooperates with the cable seals 34 to retain the female terminals 20 in their respective cavities in the event that the terminal latch tangs are damaged.

The plug connector body 12 also has an external latch projection 38 for locking the socket connector body 14 in a mated position.

The socket connector body 14 has a pair of longitudinal cavities 40 which extend through the socket connector body to provide openings at each end. Each of the cavities 40 has a forward enlarged portion 42, an intermediate reduced portion 44 and an enlarged rearward portion 46. The rearward portion 46 is of circular outline and sized to sealingly engage a cable seal 48 attached to a lead wire 50 by a male terminal 52 in the same manner as the female terminal 20 which as mentioned previously is the subject of another patent application.

The male terminal 52 also is the subject matter of another pending U.S. patent application Ser. No.

880,439 entitled "Pin Type Electrical Contact Terminal" which was filed by Robert G. Plyler and Lyle B. Suverison Feb. 23, 1978 as a Continuation-In-Part application of U.S. Ser. No. 798,460, now abandoned.

The male terminal 52 has an intermediate split barrel portion which in this instance is supported on pilot means in the intermediate cavity portion 44 comprising four diagonal pads 54 and a rearward annular shoulder 56. The male terminal 52 further comprises an elongated contact 58 at its forward end which fits in the elongated socket 30 of the female terminal 20 in a biased engagement.

The male terminal 52 is retained in the cavity 40 by lock tangs engaging the annular shoulder 56. Substantially the entire elongated contact 59 is located in the enlarged forward cavity portion 42 in a central position spaced radially from the side wall 60 of the enlarged cavity portion 42 which slidably receives an associated tower 26 of the plug connector body 12. The tip of the elongated contact 58 is preferably spaced rearwardly of the forward end of the enlarged cavity portion 42 so that the associated tower 26 initially engages the side wall 60 to guide the socket 30 into engagement with the elongated contact 58.

The sliding fit of the towers 26 in the side wall 60 of the enlarged cavity portions 42 forms part of an interface sealing arrangement which further comprises a longitudinally projecting shroud 62 at the forward end of socket connector body 14 and a seal pad 64. The shroud 62 surrounds the rearward end portions of the towers 26 and provides an internal peripheral sealing surface 66 which is forward of and spaced radially outwardly of the enlarged cavity portions 42. The seal pad 64 is made from an elastomeric material. It has a pair of longitudinal apertures 68 extending through its body by means of which the seal pad 64 is mounted on the towers 26. These apertures 68 are slightly undersized with respect to the rearward end portions of the towers 26 to effect a good seal at the tower surfaces when mounted in the position shown in FIG. 1. The seal pad 64 also has a plurality of flexible radial sealing lips 70 which are deformed into sealing engagement with the sealing surface 66 of the shroud 62 when the connector bodies 12 and 14 are mated.

The seal pad 64 provides the primary barrier against water and moisture entering the cavities 16 and 40 via the interface of the mated connector bodies 12 and 14. The radial spacing of the sealing surface 66 outwardly of the forward enlarged cavity portions 42 is a second barrier and the sliding fit between the towers 26 and the enlarged cavity portions 42 is yet a third barrier.

The effectiveness of the interface sealing arrangement is enhanced by making the overlap of the mated connector bodies 12 and 14 in the longitudinal direction as long as possible. This is accomplished by placing nearly all of the elongated sockets 30 of the female terminals 20 in their respective towers 26 and substantially the entire elongated contacts 58 of the male terminals 52 into the enlarged cavity portions 42.

While the interface sealing arrangement has been shown in connection with a two-way connector, the arrangement is applicable to other multiple connectors (three-way, four-way, etc.) and even one-way connectors. The sealing arrangement, however, is especially suitable for multiple connectors (two-way, three-way, four-way, etc.) for low current applications to avoid arcing or the bridging of adjacent sets of mated terminals by water or moisture.

Multiple connectors may employ an indexing means to insure mating of the bodies in the proper orientation. In the two-way connector shown in the drawing, this indexing means takes the form of a longitudinal slot 72 in one of the towers 26 and a mating longitudinal rib 74 in the enlarged cavity portion 42 which it slides into when the connector bodies are mated.

The socket connector body 14 also has a hinged flap 76 which is movable to closed latched position to provide a secondary lock for the male terminals 52 and a resilient latch arm 78 which cooperates with the latch projection 38 to lock the connector bodies 12 and 14 in the mated position. These are more or less standard features which, per se, do not form a part of this invention which as indicated above is directed to the interface sealing arrangement for the connector bodies 12 and 14.

We wish it to be understood that we do not desire to be limited to the exact details of construction shown and described, for obvious modifications will occur to a person skilled in the art.

What is claimed is:

1. An interface sealing arrangement for matable electrical connectors comprising:

a plug connector body having an open ended cavity which extends therethrough in a longitudinal direction and has a portion defined by a longitudinal tower at one end of the connector body, a female terminal having an elongated socket at one end retained in the cavity with the elongated socket disposed in the portion defined by the tower, a socket connector body having an open ended cavity which extends therethrough in a longitudinal direction and has an enlarged portion at one end which slidably receives the tower of the plug connector body, said socket connector body having a longitudinal projecting shroud at said one end providing an internal peripheral sealing surface forward of and spaced radially outwardly of the enlarged portion of the cavity, a male terminal having an elongated contact at one end retained in the cavity with the elongated contact disposed in the enlarged portion thereof and inserted in the elongated socket when the connector bodies are mated, and a seal pad mounted on the tower in sealing engagement therewith and in sealing engagement with the internal peripheral sealing surface of the shroud.

2. An interface sealing arrangement for matable electrical connectors comprising:

a plug connector body having a plurality of open ended cavities which extend therethrough in a longitudinal direction and have portions defined by a plurality of longitudinal laterally spaced towers at one end of the connector body, a female terminal having an elongated socket at one end retained in each cavity with the elongated socket contact disposed in the portion defined by the tower, a socket connector body having a plurality of open ended cavities which extend therethrough in a longitudinal direction and have enlarged portions at one end which slidably receive the towers of the plug connector body, said socket connector body having a longitudinal projecting shroud at said one end providing an internal peripheral sealing surface forwardly of and spaced radially outwardly of the enlarged portions of the cavities, a male terminal having an elongated contact at one end retained in each cavity with the elongated contact disposed in the enlarged portion thereof and inserted in one of the elongated sockets when the connector bodies are mated, and a seal pad mounted on the towers in sealing engagement therewith, and in sealing engagment with the internal peripheral sealing surface of the shroud.

3. An interface sealing arrangement for matable electrical connectors comprising:

a plug connector body having a plurality of open ended cavities which extend therethrough in a longitudinal direction and have portions defined by a plurality of longitudinal laterally spaced towers at one end of the connector body, a female terminal having an elongated socket at one end retained in each cavity with the elongated socket disposed in the portion defined by the tower, a socket connector body having a plurality of open ended cavities which extend therethrough in a longitudinal direction and have enlarged portions at one end which slidably receive the towers of the plug connector body, said socket connector body having a longitudinal projecting shroud at said one end providing an internal peripheral sealing surface forwardly of and spaced radially outwardly of the enlarged portions of the cavities, a male terminal having an elongated contact at one end retained in each cavity, said elongated contact being disposed in the enlarged cavity portion spaced radially from the sidewall thereof and inserted in one of the elongated sockets when the connector bodies are mated, said elongated contact having a tip spaced rearwardly of the forward end of the enlarged cavity portion whereby the side wall guides the elongated socket into engagement with the elongated contact, and an apertured seal pad mounted on the towers in sealing engagement therewith, said seal pad having a plurality of flexible radial lips in sealing engagement with the internal peripheral sealing surface of the shroud.

4. An interface sealing arrangement for matable electrical connectors comprising:

a plug connector body having a plurality of open ended cavities which extend therethrough in a longitudinal direction and have portions defined by a plurality of longitudinal laterally spaced towers at one end of the connector body, a female terminal having an elongated socket at one end retained in each cavity, each cavity having a forward portion which has means for piloting the elongated socket disposed therein, a socket connector body having a plurality of open ended cavities which extend therethrough in a longitudinal direction, and which have intermediate reduced portions and enlarged end portions at one end which slidably receive the towers of the plug connector body, said socket connector body having a longitudinal projecting shroud at said one end providing an internal peripheral sealing surface forwardly of and spaced radially outwardly of the enlarged portions of the cavities, a male terminal disposed in each cavity, each male terminal having an intermediate portion which is supported and retained in the intermediate reduced cavity portion and an elongated contact which is disposed centrally in the enlarged end portion spaced radially from the sidewall thereof, and inserted in one of the elongated sockets when the connector bodies are mated, each elongated contact having a tip spaced rearwardly of the forward end of the enlarged end portion whereby the sidewall guides the elongated socket into engagement with the elongated contact, and a seal pad having a plurality of undersized apertures extending therethrough by means of which the seal pad is mounted on the towers in sealing engagement therewith, said seal pad having a plurality of flexible radial lips in sealing engagement with the internal peripheral sealing surface of the shroud.

5. An interface sealing arrangement for matable electrical connectors comprising:

a plug connector body having a longitudinal cavity which has a portion defined by a longitudinal tower at one end of the connector body, a first terminal retained in the cavity, said first terminal having an elongated contact at one end disposed in the portion defined by the tower, a socket connector body having a longitudinal cavity which has an enlarged portion at one end which slidably receives the tower of the plug connector body, said socket connector body having a longitudinal projecting shroud at said one end providing an internal periphery sealing surface forward of and spaced radially outwardly of the elongated portion of the cavity, a second terminal retained in the aforesaid cavity, said second terminal having an elongated contact at one end disposed in the enlarged portion of the aforesaid cavity and mating with the elongated contact of the first terminal when the connector bodies are mated, and a seal pad mounted on the tower in sealing engagement therewith and in sealing engagement with the internal peripheral sealing surface of the shroud.

6. The interface sealing arrangement as defined in claim 5 wherein said seal pad has an undersized aperture extending therethrough by means of which the seal pad is mounted on the tower in sealing engagement therewith and wherein said seal pad has flexible, radial lip means in sealing engagement with the internal peripheral sealing surface of the shroud.

7. An interface sealing arrangement for matable electrical connectors comprising:

a plug connector body having a plurality of longitudinal cavities which have portions defined by a plurality of longitudinal laterally spaced towers at one end of the connector body, first terminals retained in the cavities, said first terminals having elongated contacts at one end disposed in the portions defined by the towers, a socket connector body having a plurality of longitudinal cavities which have enlarged portions at one end which slidably receive the towers of the plug connector body, said socket connector body having a longitudinal projecting shroud at said one end providing an internal peripheral sealing surface forwardly of and spaced radially outwardly of the enlarged portions of the cavities, second terminals retained in the aforesaid cavities, said second terminals having elongated contacts at one end disposed in the enlarged portions of the aforesaid cavities and mating with the elongated contacts of the first terminals when the connector bodies are mated, and a seal pad mounted on the towers in sealing engagement therewith, and in sealing engagement with the internal peripheral sealing surface of the shroud.

8. The interface sealing arrangement as defined in claim 7 wherein said seal pad has a plurality of undersized apertures extending therethrough by means of which the seal pad is mounted on the towers in sealing engagement therewith and wherein said seal pad has flexible, radial lip means in sealing engagement with the internal peripheral sealing surface of the shroud.

9. An interface sealing arrangement for matable electrical connectors comprising:

a plug connector body having a plurality of longitudinal cavities which have portions defined by a plurality of longitudinal laterally spaced towers at one end of the connector body, first terminals retained in the cavities, said first terminals having elongated contacts at one end disposed in the portions defined by the towers, a socket connector body having a plurality of longitudinal cavities which have enlarged portions at one end which slidably receive the towers of the plug connector body, said socket connector body having a longitudinal projecting shroud at said one end providing an internal peripheral sealing surface forwardly of and spaced radially outwardly of the enlarged portions of the cavities, second terminals retained in the aforesaid cavities, said second terminals having elongated contacts which are disposed in the enlarged cavity portions and spaced radially from the sidewalls of the enlarged portions, said elongated contacts mating with the elongated contacts of the first terminals when the connector bodies are mated, said elongated contacts of the second terminals having forward ends spaced rearwardly of the forward end of the enlarged cavity portions whereby the sidewalls guide the elongated contacts of the first terminals into engagement with the elongated contacts of the second terminals, and an apertured seal pad mounted on the towers in sealing engagement therewith, said seal pad having a plurality of flexible radial lips in sealing engagement with the internal peripheral sealing surface of the shroud.

10. The interface sealing arrangement defined in claim 9 wherein the apertured seal pad has a plurality of undersized apertures extending therethrough by means of which the seal pad is mounted on the towers in sealing engagement therewith.

* * * * *